US007584957B2

(12) United States Patent
Edinger

(10) Patent No.: US 7,584,957 B2
(45) Date of Patent: Sep. 8, 2009

(54) DEVICE FOR CYCLING BLAST OR SUCTION AIR IN A SHEET PROCESSING MACHINE

(75) Inventor: Holger Edinger, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 120 days.

(21) Appl. No.: 11/344,806

(22) Filed: Feb. 1, 2006

(65) Prior Publication Data

US 2006/0170150 A1 Aug. 3, 2006

(30) Foreign Application Priority Data

Feb. 1, 2005 (DE) ..... 10 2005 004 562

(51) Int. Cl.
*B65H 29/32* (2006.01)

(52) U.S. Cl. ..... 271/197; 271/276; 137/599.12

(58) Field of Classification Search ..... 271/276, 271/196, 197, 194; 269/21; 137/599.11, 137/599.12, 601.16, 601.17
See application file for complete search history.

(56) References Cited

U.S. PATENT DOCUMENTS 1,979,479 A * 11/1934 Leland ..... 408/12
2,294,407 A * 9/1942 Huffman ..... 271/197
3,197,200 A * 7/1965 Byrt ..... 271/196
3,538,571 A * 11/1970 Stark et al. ..... 29/25.41
3,603,646 A * 9/1971 Leoff ..... 406/89
3,701,363 A * 10/1972 Schuler et al. ..... 137/601.16
4,155,137 A * 5/1979 Kadlub ..... 15/4
4,260,149 A * 4/1981 Melzer ..... 271/236
4,451,029 A * 5/1984 Wildmann et al. ..... 271/236
4,790,244 A * 12/1988 Otfried et al. ..... 101/231
4,833,051 A * 5/1989 Imamura ..... 430/5
6,439,559 B1 * 8/2002 Kinnard et al. ..... 269/21
6,655,671 B2 * 12/2003 Iwaki ..... 269/21
6,871,849 B2 * 3/2005 Kerpe et al. ..... 271/182
2004/0164482 A1 * 8/2004 Edinger ..... 271/197

FOREIGN PATENT DOCUMENTS

DE 31 31 279 A1 2/1983
DE 199 01 341 A1 7/2000
DE 100 10 057 A1 9/2000

* cited by examiner

*Primary Examiner*—Patrick H Mackey
*Assistant Examiner*—Gerald W McClain
(74) *Attorney, Agent, or Firm*—Laurence A. Greenberg; Werner H. Stemer; Ralph E. Locher

(57) ABSTRACT

A device for controlling blast and/or suction air in a sheet processing machine, especially a printing press, includes a rotary valve for making ready different positive and negative pressure levels during a work cycle. The rotary valve is connected as a bypass parallel to a supply line between a consumer or load and a positive and negative pressure source. The rotary valve is connected at an input side thereof with the ambient air.

9 Claims, 3 Drawing Sheets

DEVICE FOR CYCLING BLAST OR SUCTION AIR IN A SHEET PROCESSING MACHINE

BACKGROUND OF THE INVENTION

Field of the Invention

The invention relates to a device for cycling blast or suction air in a sheet processing machine, especially a printing press.

It is known, for example, from German Published, Non-Prosecuted Patent Application 100 10 057 A1, corresponding to U.S. Pat. No. 6,364,311, to employ a lateral pulling device for a cycled control of negative pressure, in which the lateral pulling device is connected between a suction source and a load or consumer. In that regard, a problem arises in that the rotary or rotational valve employed in machines for processing paper sheets can be easily fouled or soiled by accumulating paper dust and can be cleaned again only at considerable cost.

SUMMARY OF THE INVENTION

It is accordingly an object of the invention to provide a device for cycling blast or suction air in a sheet processing machine, which overcomes the hereinafore-mentioned disadvantages of the heretofore-known devices of this general type and which is constructed so as not to be susceptible to soiling.

With the foregoing and other objects in view, there is provided, in accordance with the invention, a device for controlling blast and/or suction air in a sheet processing machine, especially a printing press. The device comprises a rotary valve for making ready different respective positive and negative pressure levels during a work cycle. The rotary valve is connected as a bypass parallel to a supply route between a consumer or load and a respective positive and negative pressure source. The rotary valve is connected at an input side thereof with surrounding air.

In accordance with another feature of the invention, the rotary valve and the positive and negative pressure source respectively have a common mixing chamber.

In accordance with a further feature of the invention, the mixing chamber is disposed in the housing of the rotary valve.

In accordance with an added feature of the invention, the mixing chamber is provided with an exchangeable filter element.

In accordance with an additional feature of the invention, the filter element is disposed so as to be accessible through a cover in the housing.

In accordance with yet another feature of the invention, the device further includes a filter leading to the surrounding air. The filter is connected upstream of the rotary valve.

In accordance with yet a further feature of the invention, the rotary valve has a rotor formed with a control slot, which has an axial and a radial connection.

In accordance with a concomitant feature of the invention, the rotary valve is associated with a suction region of a feed table in a feeder of the printing press.

An advantage of the invention lies especially in that greater maintenance intervals as well as longer service lives of the rotary valves is afforded, because the main air flow is guided past the rotary valve to the consumer or load. An especially simple accessibility through a removable cover to the interior of the rotary valve housing permits simple cleansing as well as easy replacement of a cylindrical sieve. An additionally provided filter reduces the intrusion of dirt particles from the surrounding air.

In an especially effective application, the rotary valve at a feed table is subjected to suction air. The feed table is in a feeder of a sheet processing machine. The latter is formed, for example, of three suction chambers disposed one after the other which, respectively, have a suction source. The suction air of the suction chamber facing towards the printing press has a suction chamber capable of delivering the suction air in a working or operating cycle of the machine with a varying pressure level. The device according to the invention exhibits this in an advantageous development.

Other features which are considered as characteristic for the invention are set forth in the appended claims.

Although the invention is illustrated and described herein as embodied in a device for cycling blast or suction air in a sheet processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
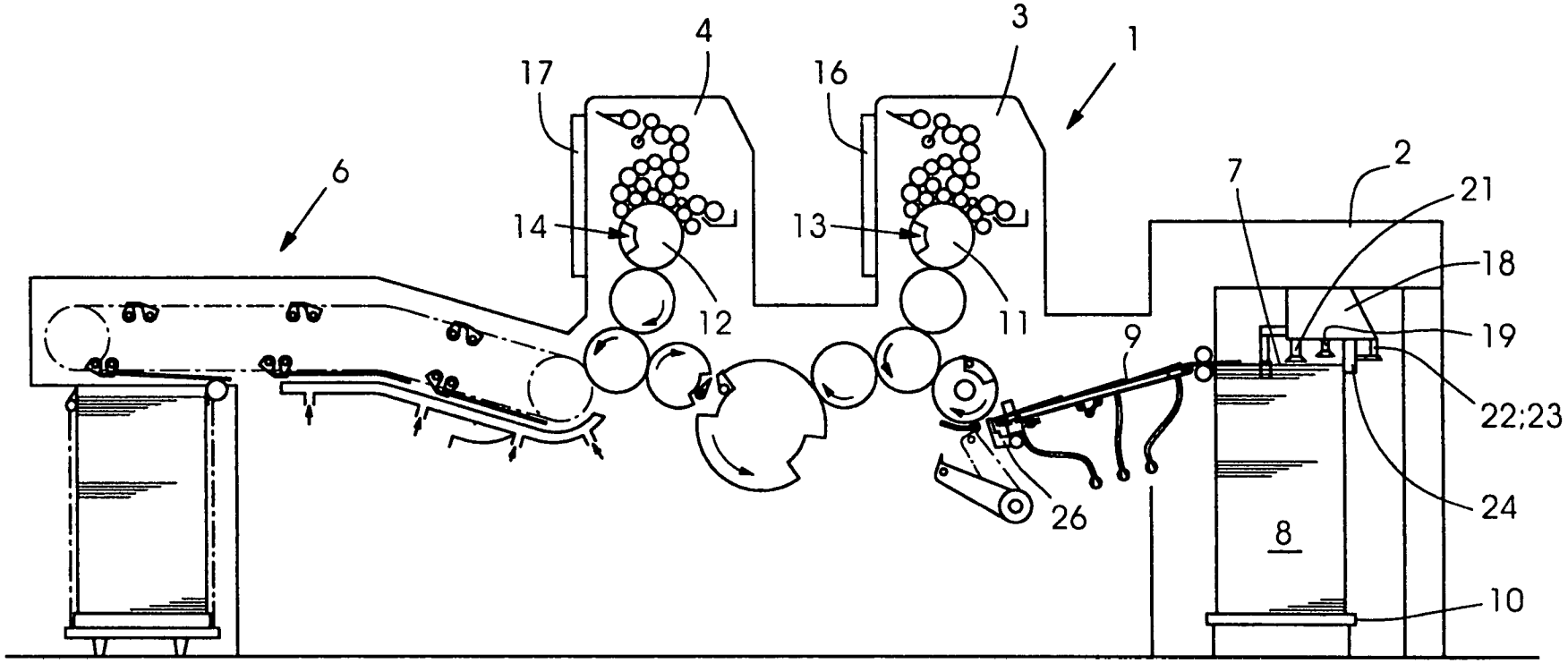
FIG. 1 is a diagrammatic, longitudinal-sectional view of a rotary printing press.

Referring now to the figures of the drawings in detail and first, particularly, to FIG. 1 thereof, there is seen a processing machine for sheets, for example a printing press 1 having a feeder 2, at least one respective printing unit 3 and 4 and a delivery 6. Sheets 7 are removed from a sheet pile 8 and fed singly or in a shingle-shaped manner over a feed table 9 to the printing units 3 and 4. The printing units 3 and 4 each include a respective plate cylinder 11, 12 in a conventional manner. The plate cylinders 11 and 12 each have a respective device 13, 14 for securing flexible printing plates thereon. Furthermore, a device 16, 17 is assigned to each plate cylinder 11, 12 for semi-automatic or fully automatic printing plate exchange.

The sheet pile 8 lies on a controlled liftable pile or stack plate 10. The removal of the sheets 7 takes place from the upper side of the sheet pile 8 by a so-called suction head 18 which, among others, has a number of lifting and pull suckers 19, 21 for the singling or separation of the sheets 7. Moreover, blowing or blast devices 22 are provided for aerating or loosening up the upper sheet installation, and test elements 23 for pile or stack resetting. A number of lateral and rear stops 24 are provided for adjusting or aligning the sheet pile 8, especially the upper sheet 7 of the sheet pile 8.

Figure 2:
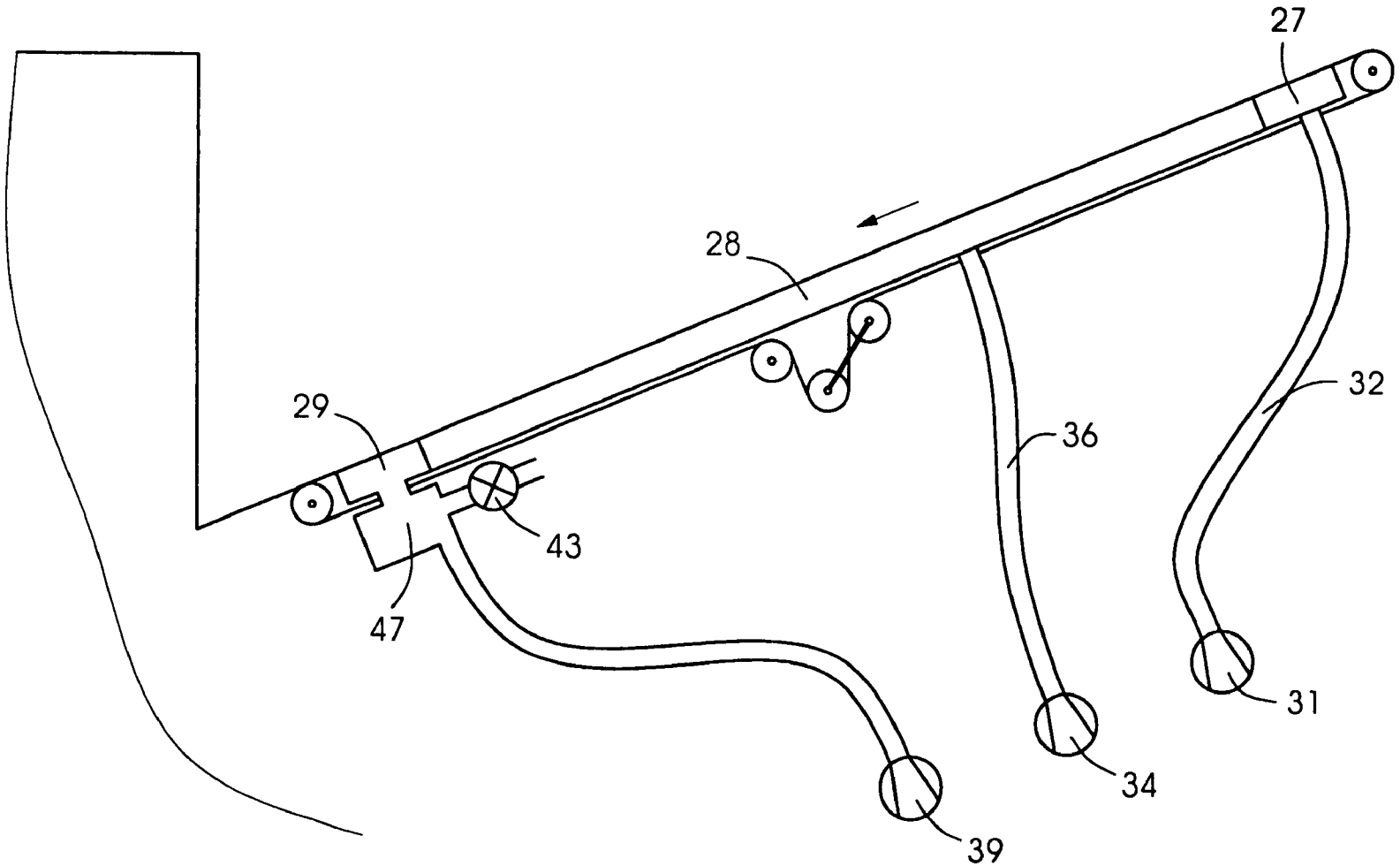
FIG. 2 is a fragmentary, longitudinal-sectional view of the printing press of FIG. 1, showing a feed table thereof with the device for cycling blast or suction air according to the invention.
Figure 3:
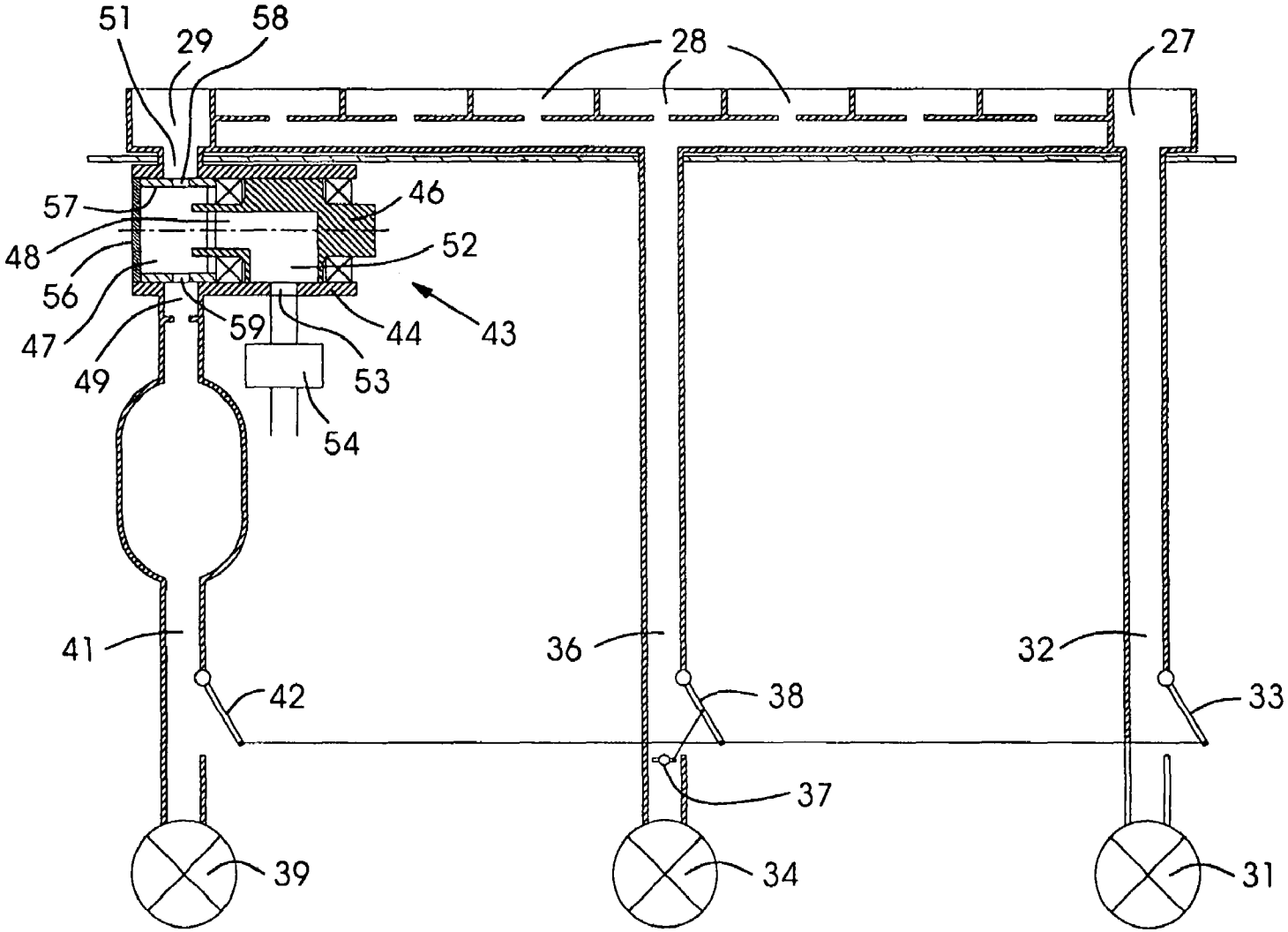
FIG. 3 is a more-detailed, sectional view of the blast or suction-air cycling device according to the invention.

The feed table 9 is formed as a so-called suction-belt table having first, second and third suction chamber regions or consumers or loads 27, 28, 29 disposed behind one another, as is shown more particularly in FIG. 2. The first suction chamber region 27 is disposed downstream of the sheet pile 8 as seen in the sheet transport direction. A first suction source 31 acts upon the first suction chamber region 27 through a supply line 32. As is further shown in FIG. 3, the supply line 32 is provided with a controllable by-pass flap 33 for surrounding or ambient air.

A second suction source 34 acts upon the second suction chamber region 28 through a supply line 36. The supply line 36 has an adjustable throttle flap 37 for controlling throughput quantities of the suction air, and a switchable bypass flap 38 for surrounding air. The second suction chamber region 28 is longer in the sheet transport direction than the respective first and third suction chamber regions 27 and 29. The second suction chamber region 28 is therefore further subdivided into several smaller suction chambers for reducing leakage losses, all of which can be acted upon in common by the second suction source 34.

A third suction air source 39 acts upon the third suction chamber region 29 with suction air through a supply line 41. The supply line 41 has a switchable bypass flap 42 to the surrounding air and a rotary valve 43 for making ready pressure levels of varying height within a work cycle of the sheet processing machine 1. The three suction sources 31, 34 and 39 may also be replaced by a single suction source having an output of corresponding size.

The rotary valve 43 has a housing 44, which accommodates therein a rotatably mounted rotor 46 driven in the work cycle of the printing press 1. Moreover, a mixing chamber 47 is provided, which is connected through an axial passage 48 with a control slot or groove 52 of the rotor 46, through a connector 49 to the supply line 41 and through a passage opening 51 to the third suction chamber region 29.

The control slot 52 of the rotor 46 of the rotary valve 43 connects the axial passage 48 with a radial inlet 53 to the surrounding air. The radial inlet 53 is provided with an exchangeable filter 54 for cleaning the intake air from the surroundings. A removable cover 56 closes an opening at an end side of the housing 44. Access to the mixing chamber 47 is made available by removing the cover 56. Due to this feature, a cylindrical filter tube or filter element 57 may be removed from the mixing chamber 47 and cleaned or exchanged. The filter tube 57 is formed with at least one first opening 58, which faces towards the passage opening 51, and at least one second opening 59, which faces towards the connection 49.

Control of the suction air and the negative pressure level in the suction regions 27, 28 is respectively effected by the suction sources 31, 34, preferably through the bypass flaps 33, 38 respectively assigned to the suction regions 27, 28.

The negative pressure supply in the suction region 29 is controlled by the suction source 39 with which, additionally, the assigned bypass flap 42 may be employed. Air from the surroundings is added through the control groove 52 of the rotor 46 of the rotary valve 43 to the mixing chamber 47 for cycling the negative pressure level in the suction region 29. Since the main suction flow at the rotor 46 of the rotary valve 43 is conducted past, or in parallel over, the mixing chamber 47, the rotary valve 43 remains substantially free of fouling or dirtying such as by dust or powder.

This application claims the priority, under 35 U.S.C. §119, of German Patent Application 10 2005 004 562.6, filed Feb. 1, 2005; the entire disclosure of the prior application is herewith incorporated by reference.

I claim:

1. A device for controlling suction air in a sheet processing machine, the device comprising:

a negative pressure source;

a consumer or load;

a supply line connected directly between said consumer or load and said negative pressure source; and a rotary valve having a rotatably disposed rotor driven in a work cycle of the sheet processing machine for making ready different negative pressure levels during the work cycle, said rotary valve being disposed in said supply line and defining a portion of said supply line, said rotary valve being connected as a bypass in parallel to said supply line, and said rotary valve having an input side in communication with ambient air.

2. The device according to claim 1, wherein said rotary valve and said negative pressure source have a common mixing chamber.

3. The device according to claim 2, wherein said rotary valve has a housing, and said mixing chamber is disposed in said housing.

4. The device according to claim 3, wherein said mixing chamber has an exchangeable filter element.

5. The device according to claim 4, wherein said housing has a cover, and said filter element is accessible through said cover.

6. The device according to claim 1, which further comprises a filter leading to the ambient air, said filter being connected upstream of said rotary valve.

7. The device according to claim 1, wherein said rotor is formed with a control slot, said control slot having an axial and a radial connection.

8. The device according to claim 1, wherein said consumer or load is a suction region of a feed table in a feeder of the sheet processing machine, and said rotary valve is assigned to said suction region.

9. The device according to claim 1, wherein the sheet processing machine is a printing press.

* * * * *